US009599104B2

(12) United States Patent
Haas et al.

(10) Patent No.: US 9,599,104 B2
(45) Date of Patent: Mar. 21, 2017

(54) VACUUM DEVICE FOR PLANTS FOR THE PROCESSING OF CONTAINERS, AND METHOD FOR CONTROLLING A VACUUM DEVICE

(75) Inventors: Gernot Haas, Eisenberg (DE); Gregor Schafer, Sankt Katharinen (DE); Olaf Muszinski, Kelkheim (DE)

(73) Assignee: KHS GmbH, Dortmund (DE)

( * ) Notice: Subject to any disclaimer, the term of this patent is extended or adjusted under 35 U.S.C. 154(b) by 384 days.

(21) Appl. No.: 14/240,893

(22) PCT Filed: Aug. 1, 2012

(86) PCT No.: PCT/EP2012/003266

§ 371 (c)(1),
(2), (4) Date: Jun. 10, 2014

(87) PCT Pub. No.: WO2013/026522

PCT Pub. Date: Feb. 28, 2013

(65) Prior Publication Data

US 2014/0356189 A1 Dec. 4, 2014

(30) Foreign Application Priority Data

Aug. 25, 2011 (DE) ..... 10 2011 111 188

(51) Int. Cl.

| | |
|---|---|
| ***B67C 3/02*** | (2006.01) |
| ***F04B 37/14*** | (2006.01) |
| ***B67C 7/00*** | (2006.01) |
| ***F04B 41/06*** | (2006.01) |
| ***F04B 49/06*** | (2006.01) |
| ***F04B 49/20*** | (2006.01) |
| *B67C 3/26* | (2006.01) |

(52) U.S. Cl.

CPC ..... *F04B 37/14* (2013.01); *B67C 3/02* (2013.01); *B67C 7/0073* (2013.01); *F04B 41/06* (2013.01); *F04B 49/06* (2013.01); *F04B 49/20* (2013.01); *B67C 2003/2688* (2013.01)

(58) Field of Classification Search

CPC ..... F04B 37/14; F04B 49/06; F04B 49/20; F04B 41/06; B67C 3/02; B67C 7/0073; B67C 2003/2688

USPC ..... 141/4–5, 7–8, 37, 59–61

See application file for complete search history.

(56) References Cited

U.S. PATENT DOCUMENTS 3,282,306 A * 11/1966 Greenhut ..... B65B 3/14 118/421

4,589,945 A 5/1986 Polit (Continued)

FOREIGN PATENT DOCUMENTS

DE 43 14 054 10/1994

DE 199 16 478 10/2000

(Continued)

*Primary Examiner* — Nicolas A Arnett

(74) *Attorney, Agent, or Firm* — Occhiuti & Rohlicek LLP

(57) ABSTRACT

An apparatus for generating negative pressure in an installation for filling containers with liquid bulk product includes a vacuum device, and a control-and-regulating unit. The vacuum device has a controllable suction power, and has a plural electrically-powered vacuum pumps. These are configured to operate in parallel. The control-and-regulating unit is configured to control the number of vacuum pumps that are active, thereby controlling the suction power.

21 Claims, 2 Drawing Sheets

(56) References Cited

U.S. PATENT DOCUMENTS

| | | | | | |
|---|---|---|---|---|---|
| 4,713,925 | A * | 12/1987 | Kafkis | B65B 31/02 | 141/31 |
| 5,176,187 | A * | 1/1993 | Grant | B60H 1/00585 | 141/10 |
| 5,636,666 | A * | 6/1997 | Mattern | B09B 3/0058 | 141/51 |
| 6,418,982 | B1 * | 7/2002 | Zhang | B65B 3/003 | 141/18 |
| 6,470,925 | B2 * | 10/2002 | Hyvarinen | E03F 1/006 | 141/65 |
| 6,488,889 | B1 * | 12/2002 | Stahlecker | A61L 2/14 | 250/455.11 |
| 7,341,078 | B1 * | 3/2008 | Xia | B65B 31/025 | 141/237 |
| 8,016,003 | B2 * | 9/2011 | Bullen | B65B 3/003 | 141/236 |
| 8,919,392 | B2 * | 12/2014 | Bullen | B65B 3/003 | 141/237 |
| 2002/0159915 | A1 * | 10/2002 | Zelina | A61L 2/186 | 422/3 |
| 2007/0186992 | A1 * | 8/2007 | Bullen | B65B 3/003 | 141/65 |

FOREIGN PATENT DOCUMENTS

| | | |
|---|---|---|
| DE | 100 28 290 | 12/2001 |
| EP | 1 595 794 | 11/2005 |
| WO | WO 02/064174 | 8/2002 |

* cited by examiner

VACUUM DEVICE FOR PLANTS FOR THE PROCESSING OF CONTAINERS, AND METHOD FOR CONTROLLING A VACUUM DEVICE

RELATED APPLICATIONS

This application is the national stage entry under 35 USC 371 of PCT application PCT/EP2012/003266, filed Aug. 1, 2012 which claims the benefit of the Aug. 25, 2011 priority date of German application 10 2011 111 188.7, the contents of which are herein incorporated by reference.

BACKGROUND

The invention relates to a vacuum device for generating negative pressure in an installation for filling containers with liquid bulk product, to an installation for the processing of such containers, and to a method for controlling such a vacuum device.

BACKGROUND

In plants for the filling of containers with a liquid bulk product, e.g. in container filling installations, with certain filling methods, a vacuum or negative pressure is needed and used to remove ambient air, and, in connection with this, the oxygen contained in the ambient air, from the containers to be filled. This step is typically carried out in a one-stage or multi-stage pre-processing phase preceding the actual filling phase.

In known vacuum devices that are used in the drinks industry, it is known to form a vacuum device by a single vacuum pump. This vacuum pump is adapted, in terms of its vacuum power and its electrical power, to the vacuum or suction power needed for the particular installation in both normal operation and in maximum operation. Changes or fluctuations in the currently necessary vacuum or suction power can then be taken into account solely within certain limits by changing the speed of the vacuum pump.

This approach results in the manufacturers of such installations providing different vacuum pumps adapted to the vacuum power required in each case for different vacuum devices with differing vacuum power levels.

Among the disadvantages of this arrangement are an increased outlay for maintaining supplies and stocks of different vacuum pumps and their spare parts, associated increased costs, and an inability to change the vacuum and suction power of the relevant vacuum device by more than a limited extent.

SUMMARY

A vacuum device according to the invention avoids the aforesaid drawbacks and allows, with a high level of operating reliability, an adaptation of the vacuum or suction power provided or to be provided by the vacuum device within a wide range, while maintaining the most optimum effectiveness possible.

According to one aspect of the invention, the vacuum device consists of at least two vacuum pumps made for parallel operation, preferably of more than two vacuum pumps made for parallel operation, wherein these vacuum pumps preferably are of the same design and have the same power. A substantial partial aspect of the invention consists of the complete vacuum or suction power of the vacuum device being controlled by the speed and the number of activated vacuum pumps.

Advantages of the invention include reduced energy and power consumption, reduction of stock-holding and stock-holding costs, in particular of spare parts, shorter delivery times for spare parts, part-redundancy, simplified maintenance, and the saving of water as a result of having common seal-water conditioning for all the vacuum pumps.

Moreover, the invention offers the possibility of retrofitting existing vacuum devices accordingly.

As used herein, the expressions "substantially" and "approximately" are intended to mean deviations from exact values in each case by +/−10%, and preferably by +/−5% and/or deviations that do not significantly affect function.

As used herein, the expression "pour rate" means the filling performance, measured for example in liters provided by the container-filling machine per unit of time.

As used herein, the term "containers" means, in particular, cans, bottles, tubes, or pouches, in each case made of metal, glass and/or plastic, as well as other packaging means that are suitable for filling with liquid or viscous products.

Further developments, benefits and application possibilities of the invention arise also from the following description of examples of embodiments and from the figures. In this regard, all characteristics described and/or illustrated individually or in any combination are categorically the subject of the invention, regardless of their inclusion in the claims or reference to them. The content of the claims is also an integral part of the description.

BRIEF DESCRIPTION OF THE FIGURES

The invention is explained in more detail below by means of the figures using an example of an embodiment. The following are shown.

DETAILED DESCRIPTION

Figure 1:
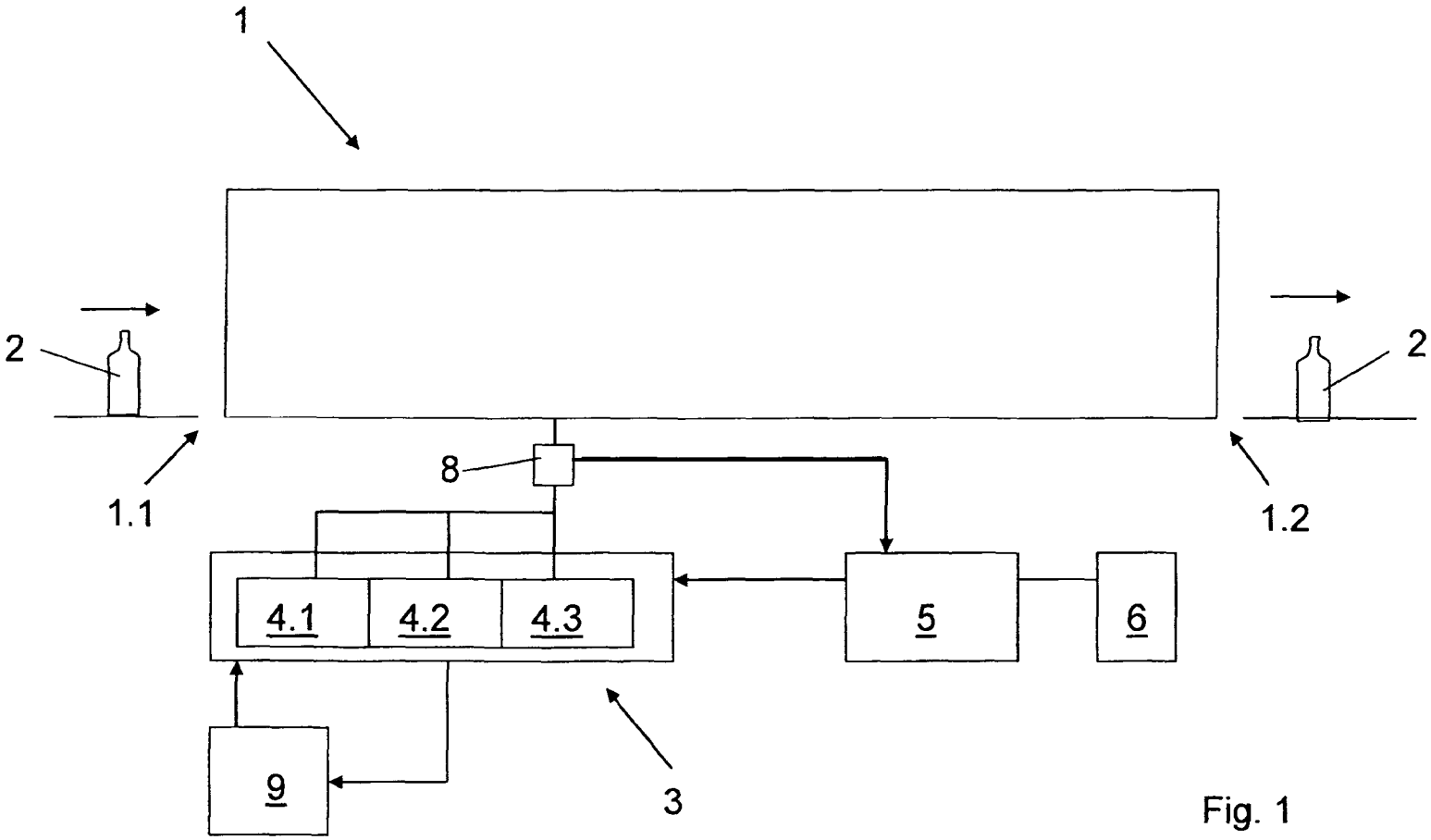
FIG. 1 is a function or block diagram of a container-processing machine together with a vacuum device.

FIG. 1 shows an installation 1 for the processing of containers 2, for example, bottles. The installation 1 includes at least one device or machine, for example, a filling machine, in which the containers 2 and/or device areas are subject to a vacuum or a negative pressure, for example a negative pressure in the range of 80 millibar and 100 millibar. The containers 2 are supplied to the installation 1 on a container inlet 1.1 and removed from the installation 1 on a container outlet 1.2.

A central vacuum device 3 for the installation 1 generates the necessary negative pressure or the vacuum, a. The central vacuum device 3 features a multiplicity of electrically powered vacuum pumps 4.1-4.3. In the embodiment illustrated, the vacuum device 3 has a total of three vacuum pumps 4.1-4.3. The vacuum or suction power of each such pump 4.1-4.3 can be individually controlled or adjusted within certain limits by changing the pump speed. To do this, the electrical control of the drive motor of the particular vacuum pump 4.1-4.3 adjusts the drive frequency using a frequency controller. The frequency is adjusted within a frequency range that extends between 40 Hz and 60 Hz.

In FIG. 1, control electronics or a machine control system 5 includes a process computer associated with the installation 1 for controlling the vacuum pumps 4.1-4.3 by, for example, switching, controlling, or adjusting the vacuum pumps 4.1-4.3 based on process parameters as described in greater detail below.

The process parameters can, for example, be retrieved from a memory in the control electronics and/or can be input by means of an input 6 in the control electronics.

In an installation for the filling of containers 2, wherein the containers are subject one or more times to a vacuum, for example before the actual filling, and then flushed with an inert gas, for example $CO_2$ gas, the process parameters can be product-specific parameters, the container size, the filling temperature, etc.

With these process parameters, for a special processing method and for a temperature for the seal water circuit of the vacuum pumps 4.1-4.3, the number of pumps needed in each case is determined, for example, by a table and entered or input into the machine control system 5 at the start of production so that the production of the installation 1 can be started with this number of pumps (start condition).

In the tables below, the number of vacuum pumps 4.1-4.3 needed in each case for three processing methods carried out with installation 1, i.e. for three different filling methods and for different temperatures of the seal water of the vacuum pumps, depending on the suction power, is given in $m^3/h$.

| | | Number of pumps | | |
|---|---|---|---|---|
| | Temperature | 1 | 2 | 3 |
| Method 1 | 15° C. | 19 $m^3/h$ | 38 mVh | 57 $m^3/h$ |
| | 20° C. | 18 $m^3/h$ | 36 mVh | 54 $m^3/h$ |
| | 25° C. | 16 $m^3/h$ | 32 mVh | 48 $m^3/h$ |
| | 30° C. | 14 $m^3/h$ | 28 $m^3/h$ | 40 $m^3/h$ |
| Method II | 15° C. | 10 $m^3/h$ | 21 $m^3/h$ | 32 $m^3/h$ |
| 3 × flushing | 20° C. | 10 $m^3/h$ | 20 $m^3/h$ | 30 $m^3/h$ |
| | 25° C. | 9 $m^3/h$ | 18 $m^3/h$ | 27 $m^3/h$ |
| | 30° C. | 6 $m^3/h$ | 14 $m^3/h$ | 22 $m^3/h$ |
| Method III | 15° C. | 16 $m^3/h$ | 33 $m^3/h$ | 48 $m^3/h$ |
| | 20° C. | 14 $m^3/h$ | 31 $m^3/h$ | 45 $m^3/h$ |
| | 25° C. | 13 $m^3/h$ | 27 $m^3/h$ | 40 $m^3/h$ |
| | 30° C. | 12 $m^3/h$ | 25 $m^3/h$ | 36 $m^3/h$ |

As mentioned above, the suction power of the vacuum pumps 4.1-4.3 is controlled or adjusted by their speed. In this regard, it is necessary to specify the speed of the vacuum pump 4.1-4.3 depending on the pump type used such that it can be operated economically reasonably, i.e. with the most optimum efficiency possible. For every pump type, taking account of the frequency of the operating voltage, or mains voltage, the power consumption, the mechanical efficiency, the hydraulic efficiency and the electrical efficiency, a pump characteristic curve can be established that reflects the electrical power rating, i.e. the electrical power requirement as a function of the vacuum or suction power. In the event that other parameters, such as the seal water temperature for example, have a not inconsiderable influence on the electrical power requirement of the particular vacuum pump 4.1-4.3, they are also taken into account in the pump characteristic curve. Alternatively, parameter-specific pump characteristic curves are established.

In the applicant's premises, in trials on a vacuum pump in different operating statuses, various specific power requirements were established. These values ranged from 27 $m^3/kW$ to 40 $m^3/kW$. It is clear from these values that there is considerable optimization potential here.

Figure 2:
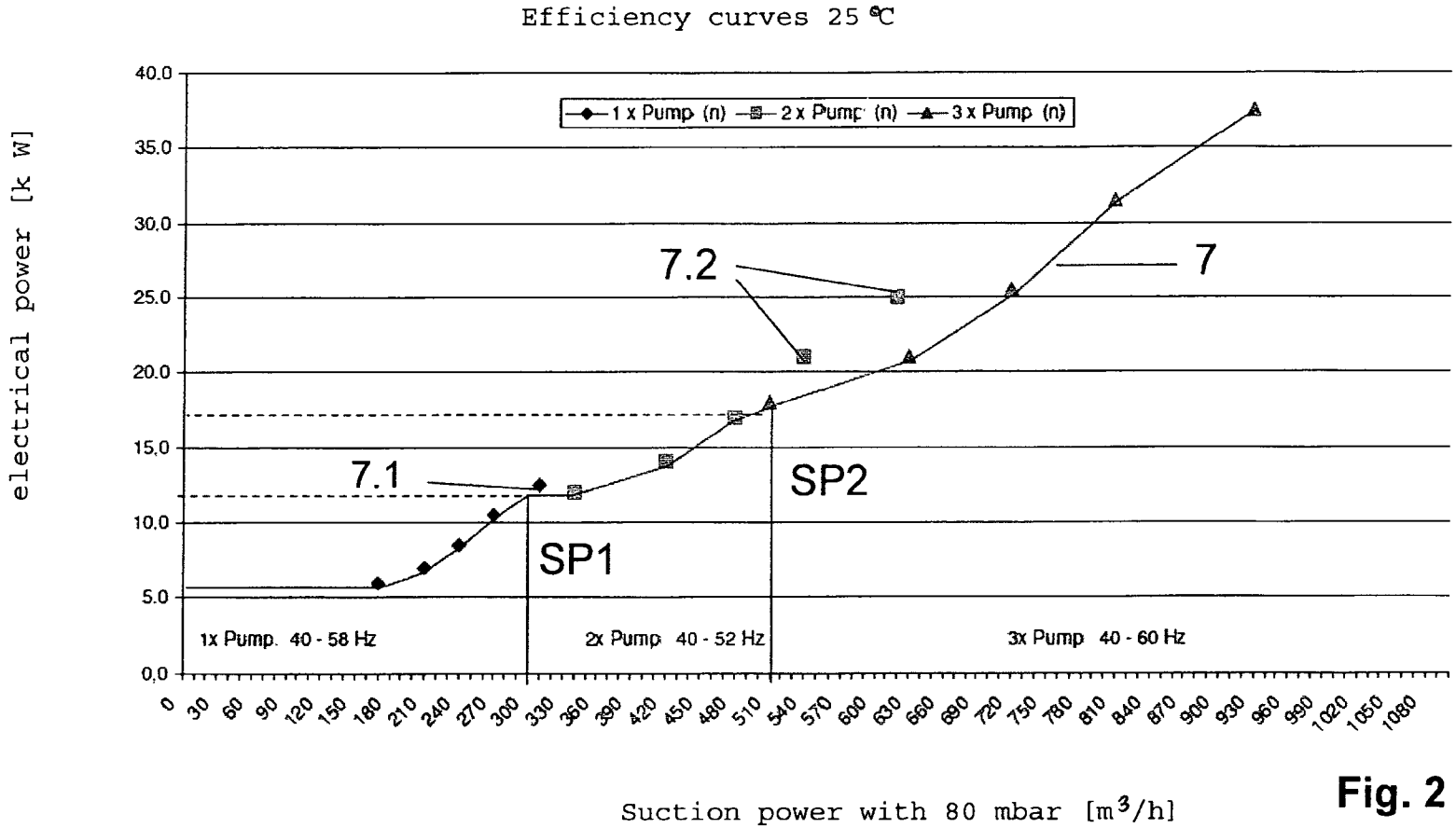
FIG. 2 is a diagram showing a relationship between the electrical power of the vacuum device and the suction power at a specified negative pressure.

Taking account of the pump characteristic curve, preferably also taking account of the overall efficiency of the vacuum device 3 and the area supplying the vacuum of installation 1, the overall characteristic curve 7 shown in FIG. 2 is formed. This curve reflects, at a specified constant negative pressure generated by the vacuum device 3, i.e. in the illustrated embodiment at a negative pressure of 80 mbar, the electrical power requirement in kW depending on the suction power $m^3/h$. This overall characteristic curve 7 is held in the memory of the machine control system 5. During the running operation of the installation 1, for example starting from the start condition specified by means of the table above, further adjustment and control of the vacuum device 3 is carried out using this characteristic curve 7.

A substantial part of the overall characteristic curve 7 are the switching points, identified on the curve 7 by SP1 and SP2, at which the change in the number of vacuum pumps 4.1-4.3 to a higher or lower number of vacuum pumps occurs. For example, a transition between one vacuum pump and two vacuum pumps, operated in parallel, occurs at switching point SP1 and a transition between two vacuum pumps operated in parallel to three vacuum pumps operated in parallel takes place at switching point SP2. In one embodiment, the electrical power supplied to the vacuum device, which is monitored by the machine control system, serves as a criterion for the change by the machine control system 5.

As can be seen from the diagram in FIG. 2, there would also be the possibility basically of achieving a higher suction power going beyond the switching point SP1 even with only a single vacuum pump 4.1-4.2. But doing so would come at the cost of clear deterioration in efficiency and thus with a higher electrical power requirement, as indicated in the diagram by the operating point 7.1.

Moreover, the operating point represents a possible operating point during the operation of a single vacuum pump 4.1-4.3, wherein the suction power and allocated power requirement are known also for this operating point of a single vacuum pump. As can be seen from FIG. 2, with the suction power allocated to operating point 7.1, the power requirement of a single vacuum pump lies substantially above the power requirement of two vacuum pumps operated in parallel.

Similarly, with just two vacuum pumps operated in parallel, the suction power could be increased beyond the suction point SP2. Again, doing so would come at the cost of clearly worsening efficiency, with an accompanying clear rise in the electrical power requirement, as indicated in the diagram by the operating points 7.2.

As also shown in FIG. 2, the pumps are operated in the various operating statuses at different frequencies and thus at different pump speeds, namely in the operating status with only one activated vacuum pump 4.1-4.3 with a frequency of 40 to 58 Hz, in the operating status with two activated vacuum pumps 4.1-4.3 with a frequency of 40 to 52 Hz and in the operating status with three activated pumps with a frequency of 40 to 60 Hz.

The overall characteristic curve shown in FIG. 2 takes into account a seal water temperature of the vacuum pumps 4.1-4.3 of, for example, 25° C. If the seal water temperature has a greater influence on the pump characteristic curve or on the efficiency of the vacuum pumps 4.1-4.3, then for each seal water temperature, different overall characteristic curves 7 arise. These are then taken into account for the control and adjustment of the vacuum pumps 4.1-4.3 during the running process.

In addition, the seal water temperature during the operation of installation 1 is preferably continuously measured and transmitted to the machine control system. The machine control system 5 then uses the overall characteristic curve 7 allocated in each case in order to control or adjust the installation.

The overall characteristic curve 7, shown by way of example, also assumes that the vacuum pumps 4.1-4.3 working in parallel are operated in each case at the same frequency as the supply voltage. Although this represents a solution that is easy to implement, the operation of the vacuum pumps 4.1-4.3 working in parallel at the same frequency as the supply voltage is not essential. In the context of the present invention, it is also possible for the individual vacuum pumps 4.1-4.3 operated in parallel to run at different supply frequencies. This creates the possibility of increasing the efficiency of the entire installation, at least for some vacuum power levels.

To guarantee a correct supply to the installation 1 of the vacuum and thereby in particular to also guarantee a correct vacuum processing of the containers 2, it is essential for a specified target negative pressure, for example the negative pressure of 80 mbar-100 mbar, to be present in the corresponding vacuum pipes and/or connections. This negative pressure is identical to the negative pressure on the intake side of the activated vacuum pumps 4.1-4.3.

FIG. 1 shows a pressure sensor 8 in a vacuum pipe between the vacuum device 3 and the installation 1 to monitor this negative pressure. Depending on the electrical measuring signal generated by pressure sensor 8, the machine control system 5 causes at least the vacuum power of one of the activated vacuum pumps 4.1-4.3 to changed by a corresponding adaptation of the frequency. This causes a change in the pump speed so that the negative pressure provided by the vacuum device 3 corresponds to the target negative pressure.

If, as a result of this adjustment of the pump speed for example, the next higher switching point SP1 or SP2 is reached, the machine control system 5 switches according to the overall characteristic curve 7 to the next higher number of vacuum pumps 4.1-4.3 operated in parallel. If, in the other direction, a reduction in the suction power of the vacuum unit 3 and thus a reduction in the pump speed is required, then, upon reaching the switching point SP1 or SP2, the machine control system 5 switches to the next lower number of activated vacuum pumps 4.1-4.3.

Also shown in FIG. 1 is a device 9 for providing and/or conditioning seal water jointly for all the vacuum pumps 4.1-4.3 of the vacuum device 3. The device 9 forms part of a water circuit through the vacuum pumps 4.1-4.3 and can include, among other things, a device for cooling the seal water and connections for venting, supplying fresh water, and removing waste water.

Taking account of the power consumption of the vacuum unit 3 and the overall characteristic curve 7, a function and fault monitoring of the entire installation is furthermore possible. The machine control system 5 knows how many vacuum pumps 4.1-4.3 need to be operated for a certain operating status of the installation at a specified frequency of the supply voltage or what target energy consumption arises in the particular operating status. If the corresponding value, i.e. the number of activated vacuum pumps 4.1-4.3, the frequency of the supply voltage for these pumps, and thus also the energy consumption for the maintenance of the target negative pressure differ from the target values by more than a particular amount, which is defined by a specified admissible tolerance range, then there is a fault in the vacuum device 3 or in the installation 1, for example in the form of a relatively large leak. In this case, a warning or indication signal or a warning or indication message is distributed by the machine control system 5 or by another monitoring unit. In the event of substantial differences from the target values, the machine control system causes, for example, a power-down and halt of the installation 1.

Only in a few operating statuses of the installation 1 is it necessary for all the vacuum pumps 4.1-4.3 of the vacuum device 3 to be activated simultaneously. Instead, during a large part of the operating time of the vacuum installation 3, only some of the available vacuum pumps 4.1-4.3 are in use. To keep the operating times, and thus the intervals for inspections, maintenance, repairs etc. for all the vacuum pumps 4.1-4.3 as identical as possible, the machine control system 5 is furthermore designed to capture the particular operating time or operating hours of each individual vacuum pump 4.1-4.3 and to save the corresponding data. In this way, different methods arise for keeping operating times for all the vacuum pumps 4.1-4.3 as identical as possible.

According to a first method, both at the start of the process and also during the running of the process, the vacuum pumps 4.1-4.3 which at that time have the lowest cumulative operating times are preferentially activated by the machine control system 5 so that an even use of all the vacuum pumps 4.1-4.3 occurs and the relevant maintenance is due at the same time for all the vacuum pumps.

According to another method, the vacuum pumps 4.1-4.3 to be activated are selected in each case such that the maintenance for some of the vacuum pumps 4.1-4.3 then arises where the installation 1 and/or its components require maintenance, so that, for example, the number of production interruptions and/or interventions for service personnel and thus also the associated costs incurred are also considerably reduced.

According to another operating method, a vacuum pump 4.1-4.3 is locked when, due to its operating hours and/or its condition, maintenance of that pump is absolutely essential. The operation of the vacuum device 3 then occurs solely with the remaining vacuum pumps 4.1-4.3, which have not been locked. The maintenance, which would also include any necessary repairs of the locked vacuum pump is then carried out during running operation.

Naturally, the aforesaid operating methods can also be combined for the operation of the vacuum pumps 4.1-4.3.

The invention has been described above using examples of embodiments. It is clear that modifications and variations are possible without thereby departing from the inventive idea underlying the invention. Thus, above it is assumed that the vacuum device 3 has a total of three vacuum pumps 4.1-4.3. The number of these pumps can differ from this, but in any event is greater than one.

REFERENCE DRAWING LIST

1 Installation for processing containers
1.1 Container inlet
1.2 Container outlet
2 Container
3 Vacuum device
4.1-4.3 Vacuum pump
5 Machine control system
6 Input in the machine control system 5
7 Overall characteristic curve
7.1, 7.2 Operating point
8 Pressure sensor
9 Installation for the provision and/or conditioning of seal water
SP1, SP2 Switching point

The invention claimed is:

1. An apparatus for generating negative pressure in an installation for filling containers with liquid bulk product, said apparatus comprising a vacuum device, and a control-and-regulating unit, wherein said vacuum device has a controllable suction power, wherein said vacuum device comprises a plurality of electrically-powered vacuum pumps, wherein said electrically-powered vacuum pumps are configured to operate in parallel, and wherein said control-and-regulating unit is configured to control the number of vacuum pumps that are active, thereby controlling said suction power.

2. The apparatus of claim 1, wherein said vacuum pumps are powered by a supply voltage, wherein said supply voltage has a frequency, wherein said vacuum pumps are configured to have a suction power that depends on said supply voltage, and wherein said control-and-regulating unit is configured to change said frequency.

3. The apparatus of claim 1, wherein said control-and-regulating unit is configured to change said frequency within a range that extends between 40 Hz and 60 Hz.

4. The apparatus of claim 1, wherein said control-and-regulating unit is configured to control said suction power based at least in part on a process parameter of said installation.

5. The apparatus of claim 4, wherein said process parameter is the type of processing method carried out by said installation.

6. The apparatus of claim 1, wherein said control-and-regulating unit is further configured to control, during operation thereof, a suction power of each electrically-powered vacuum pump from said plurality of electrically-powered vacuum pumps.

7. The apparatus of claim 6, wherein an overall characteristic curve of said vacuum device has switching points at which said vacuum device switches from a first state to a second state, wherein in said first state, a first number of said vacuum pumps is activated, wherein in said second state, a second number of said vacuum pumps is activated, and wherein said first number and said second number differ by one.

8. The apparatus of claim 1, wherein said control-and-regulating unit is further configured to switch on and switch off each electrically-powered vacuum pump from said plurality of electrically-powered vacuum pumps based at least in part on an overall characteristic curve of said vacuum device, wherein said overall characteristic curve reflects electrical power needed for driving said vacuum pumps at maximum suction power taking into account pump characteristic curves of each of said vacuum pumps, and wherein said pump characteristic curves of said vacuum pumps provide a relationship between suction power of said pumps and electrical power requirements of said pumps.

9. The apparatus of claim 1, wherein said vacuum pumps are all of identical construction.

10. The apparatus of claim 1, further comprising a common device for at least one of providing and conditioning seal water for all of said vacuum pumps.

11. The apparatus of claim 4, wherein said process parameter is container geometry.

12. The apparatus of claim 4, wherein said process parameter is container shapes.

13. The apparatus of claim 4, wherein said process parameter is filling output.

14. A method for filling containers with a liquid bulk product, said method comprising controlling a vacuum device that has a controllable suction power, wherein said vacuum device comprises a plurality of electrically-powered vacuum pumps, and wherein said electrically-powered vacuum pumps are configured to operate in parallel, said method comprising controlling the number of vacuum pumps that are active, thereby controlling said suction power.

15. The method of claim 14, further comprising, based at least in part on a container processing method to be implemented, determining the number of vacuum pumps that are required for operation, and turning on said number of said vacuum pumps.

16. The method of claim 14, wherein controlling the number of vacuum pumps that are active comprises controlling said number based on process parameters of an installation for processing said containers, wherein said process parameters take into account at least one of a type of processing method, container sizes, container shapes, and filling output of a container filling machine.

17. The method of claim 14, wherein controlling the number of vacuum pumps that are active comprises taking into account an overall characteristic curve of said vacuum device, wherein said overall characteristic curve takes into account pump characteristic curves of said vacuum pumps, said pump characteristic curves reflecting a relationship between suction power and electrical power requirements.

18. The method of claim 14, wherein controlling the number of vacuum pumps that are active comprises switching said vacuum device between a first state and a second state, wherein in said first state, a first number of vacuum pumps is activated, wherein in said second state a second number of vacuum pumps is activated, and wherein said first number and said second number differ by one.

19. The method of claim 14, wherein said pumps define a first set and a second set, wherein said first set includes all currently active pumps and said second set includes all currently inactive pumps, wherein each pump has a cumulative operating time, and wherein controlling the number of vacuum pumps that are active comprises selecting, from said second set, said pump having a lowest cumulative operating time, and activating said pump, thereby maintaining substantially the same operating times for all pumps.

20. The method of claim 14, wherein said pumps define a first set and a second set, wherein said first set includes all currently active pumps and said second set includes all currently inactive pumps, wherein each pump has a cumulative operating time, wherein controlling the number of vacuum pumps that are active comprises selecting an inactive pump from said second set to cause maintenance of said selected pump to be due at the same time as maintenance of the vacuum device is due.

21. The method of claim 14, further comprising carrying out maintenance of a vacuum pump after said vacuum pump has been locked and while other vacuum pumps are active.

* * * * *